United States Patent [19]

Mercier

[11] 4,371,791

[45] Feb. 1, 1983

[54] TIME DELAY SWITCH

[75] Inventor: Olivier Mercier, Ennetbaden, Switzerland

[73] Assignee: BBC Brown, Boveri & Company, Limited, Baden, Switzerland

[21] Appl. No.: 280,487

[22] Filed: Jul. 6, 1981

[30] Foreign Application Priority Data

Jul. 8, 1980 [CH] Switzerland ..... 5206/80

[51] Int. Cl.[3] ..... H01H 7/00

[52] U.S. Cl. ..... 307/141

[58] Field of Search ..... 307/113, 117, 141

[56] References Cited

U.S. PATENT DOCUMENTS

| | | | |
|---|---|---|---|
| 3,193,711 | 7/1965 | Western | 307/141 |
| 3,371,254 | 2/1968 | Hagfors | 307/113 X |
| 3,725,644 | 4/1973 | Bailey | 307/117 X |

*Primary Examiner*—Donald A. Griffin

*Attorney, Agent, or Firm*—Oblon, Fisher, Spivak, McClelland & Maier

[57] ABSTRACT

A time delay switch capable of connecting a consuming device to a power source via a first current path for a predetermined time and including a first normally open circuit breaker connected in the first current path. A second current part is provided including the first normally open circuit breaker and an auxiliary normally closed circuit breaker connected in series with a thermal element made of a memory alloy characterized by a two-way temperature sensitive shape changing characteristic and a resistive heater electrically connected in series with the thermal element and thermally coupled thereto. A push-button activator is provided which upon actuation thereof closes the contact of the first circuit breaker resulting in current flowing in the first and second current paths, thereby producing heating of the thermal element and a corresponding shape change therein. After a predetermined time the shape change of the thermal element acts on the auxiliary circuit breaker and opens the contacts thereof, thereby ending the heating of the thermal element which then cools down and returns to its initial shape, which results in opening of the normally open first circuit breaker, whereby the flowing of the current to the consuming device ceases.

1 Claim, 7 Drawing Figures

TIME DELAY SWITCH

BACKGROUND OF THE INVENTION

1. Field of the Invention

This invention relates to a time delay switch of the kind capable of connecting a power consuming device to a power source for a predetermined time period and which utilizes a thermal element characterized by a temperature sensitive shape changing characteristic.

2. Description of the Prior Art

Thermal time switches have been known for a long time (German Pat. No. 705 383, German Disclosure Publication No. 25 44 758). They work generally in accordance with the principle of a bimetallic strip or of any expansion element which changes its shape after a certain time as a function of the temperature determined by the thermal and electrical characteristic data. In this way, the device can be operated to cut a circuit in and out.

Furthermore, the application of alloys with a shape memory is known for the interruption of electric circuits. The temperature control in which the memory effect takes place using a reacting spring has also been described (Swiss Pat. No. 616 270, European Patent 78200393.3).

Alloys with a shape memory are actually also known from numerous publications which will not be especially listed here. It is particularly a question of the alloy types Ni/Ti/Cu, Cu/Al/Ni and Cu/Zn/Al. The physical properties of such alloys with a shape memory are listed in the following table and are compared with those of bimetallic strips Fe/Ni.

| Properties | Alloys | |
|---|---|---|
| | $Ni/Ti/Cu_{10}$ | Cu/Al/Ni |
| Density d | $6.35 \times 10^3$ kg/m$^3$ | $7.2 \times 10^3$ kg/m$^3$ |
| Specific heat Cp | $2.98 \times 10^6$ J/m$^3$K | $3.32 \times 10^6$ J/m$^3$K |
| Latent heat ΔH | $110 \times 10^6$ J/m$^3$ | $60 \times 10^6$ J/m$^3$ |
| Electric conductivity $\sigma_e$ | $1.2 \times 10^6$ S/m | $9 \times 10^6$ S/m |
| Thermal conductivity λ (20° C.) | 10 J/m K | 75 J/m K |
| Magnetic induction co-efficient | <1.002 | ~1 |
| Max. work (2-way effect) | $2 \times 10^6$ J/m$^3$ | $1.3 \times 10^6$ J/m$^3$ |
| Switching temperature | −200° C. to +100° C. | −100° C. to +200° C. |
| Overheating temperature | +400° C. | +300° C. |
| Elasticity modulus | 70 Gn/m$^2$ | 75 GN/m$^2$ |
| Shearing modulus | 15–25 GN/m$^2$ | 35 GN/m$^2$ |

| Properties | Alloys | |
|---|---|---|
| | Cu/Zn/Al | Bimetal Fe—Ni |
| Density d | $7.65 \times 10^3$ kg/m$^3$ | $8.1 \times 10^3$ kg/m$^3$ |
| Specific heat Cp | $3.07 \times 10^6$ J/m$^3$K | $4.06 \times 10^6$ J/m$^3$K |
| Latent heat ΔH | $30 \times 10^6$ J/m$^3$ | — |
| Electric conductivity $\sigma_e$ | $3 \times 10^6$ S/m | $1.25 \times 10^6$ S/m |
| Thermal conductivity λ (20° C.) | 25 J/m K (?) | 8 J/m K |
| Magnetic induction co-efficient | ~1 | |
| Max. work (2-way effect) | $1.0 \times 10^6$ J/m$^3$ | $0.02 \times 10^6$ J/m$^3$ (ΔT = 100K) |
| Switching temperature | −100° C. to +90° C. | −20° C. to +300° C. |
| Overheating temperature | +150° C. (?) | +500° C. |
| Elasticity modulus 60–70 GN/m$^2$ | | |
| Shearing modulus | 35 GN/m$^2$ | |

Customary time switches are distinguished by the fact that the active element (bimetallic strip or element expanding under the influence of the temperature) changes its shape only very little with a change in temperature and this change is, furthermore, effected in a continuous manner. This make the switches voluminous and expansive and the mechanisms determining the cut-in time can only be produced under great difficulties. An additional mechanism is necessary in order to ensure the clear cut-in and cut-out position of the switch owing to the absence of a temperature hysteresis of the active element. Therefore, there is a distinct requirement for the improvement and simplification of time delay switches in comparison with the traditional designs.

SUMMARY OF THE INVENTION

Accordingly, one object of this invention is to provide a novel time delay switch which permits a financially favorable production with as simple a design as possible and a maximum of accuracy and reliability in operation.

This and other objects are accomplished according to the invention by providing a new and improved time delay switch capable of connecting a consuming device to a power source via a first current path for a predetermined time and including a first normally open circuit breaker connected in the first current path. A second current path is provided including the first normally open circuit breaker and an auxiliary normally closed circuit breaker connected in series with a thermal element made of a memory alloy characterized by a two-way temperature sensitive shape changing characteristic and a resistive heater electrically connected in series with the thermal element and thermally coupled thereto. A push-button activator is provided which upon actuation thereof closes the contact of the first circuit breaker resulting in current flowing in the first and second current paths, thereby producing heating of the thermal element and a corresponding shape change therein. After a predetermined time the shape change of the thermal element acts on the auxiliary circuit breaker and opens the contacts thereof, thereby ending the heating of the thermal element which then cools down and returns to its initial shape, which results in opening of the normally open first circuit breaker, whereby the flowing of current to the consuming device ceases.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
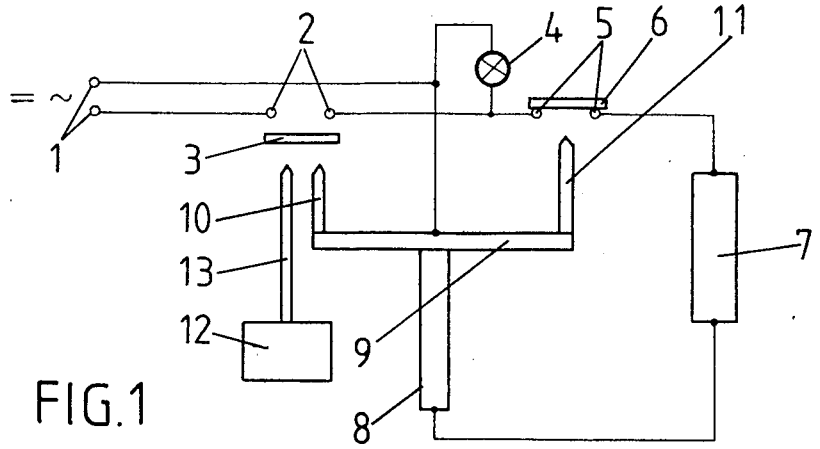
FIG. 1 is a schematic representation of the structure of the switch according to the invention with circuit breakers in their non-actuated (low temperature) position.

Referring now to the drawings, wherein like reference numerals designate identical or corresponding parts throughout the several views, and more particularly to FIG. 1 thereof, the structure of the time delay switch is schematically represented in its basic position. Reference numeral designation 1 designates the current supply terminals for the main supply line (direct and alternating current supply), 2 designates the stationary contacts, and 3 designates the mobile contact portion of a circuit breaker through which, for example, a lamp is supplied as the consuming device 4. The circuit is normally open in the basic position. Numeral 5 and 6 respectively represent the stationary contacts and the movable contact of an auxiliary switch which supplies the element 8, consisting of a memory alloy and a reacting spring, through a compensating resistance 7. The tripping pins 10 and 11 of element 8 are located on a traverse 9 for the actuation of the circuit breaker or auxiliary switch. Numeral 12 designates a push button for short-term actuation (a fraction of a second) and numeral 13 designates a respective tripping pin.

Figure 2:
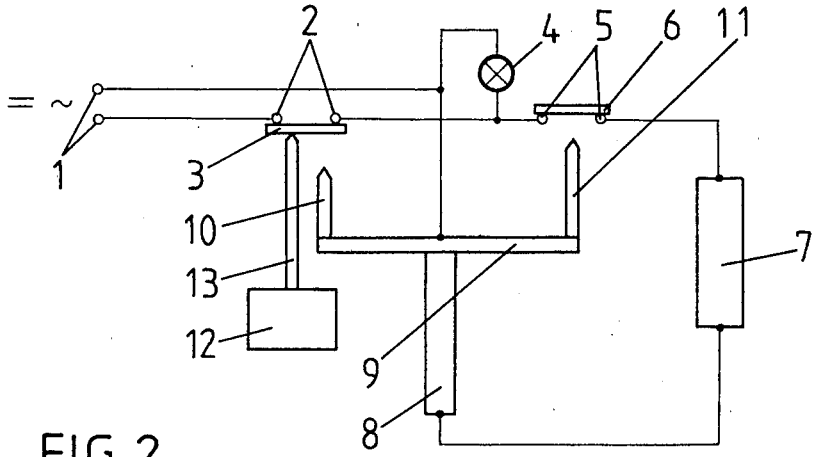
FIG. 2 is a schematic representation of the structure of the switch according to the invention with the electric circuits after being cut-in through a push button.

FIG. 2 shows the same switch arrangement as FIG. 1 but at the moment of the short-term actuation by the push button 12 which pushes the mobile contact portion 3 to the stationary contacts 2 of the circuit breaker through the tripping pin 13. In this way, the electric circuit is closed and the consuming device 4 as well as the element 8 are cut in. The remaining reference numbers are the same as in FIG. 1.

Figure 3:
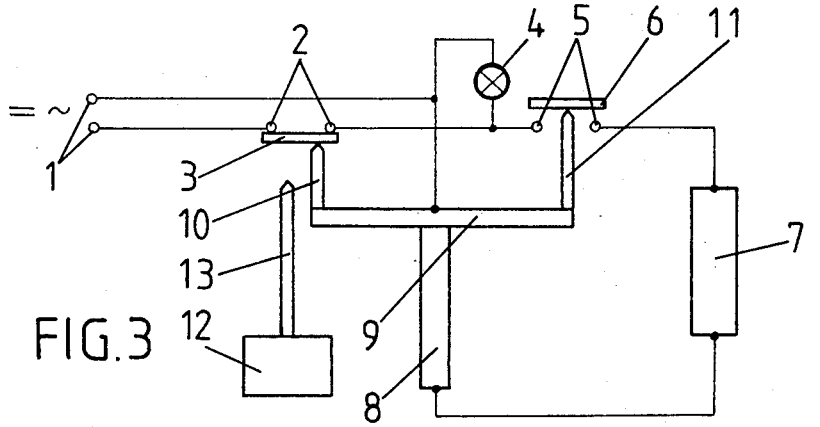
FIG. 3 is a schematic representation of the structure of the switch according to the invention with the electric circuits after the setting-in of the memory effect and release of the push button.

FIG. 3 shows the structure of the switch with the circuits after the memory effect has set in. In this position, the tripping pins 10 and 11 are lifted up so that the mobile contact portion 3 of the circuit breaker is pushed against the stationary contacts 2 while the mobile contact portion 6 of the auxiliary switch is lifted off the stationary contacts 5. The push button 12 with its tripping pin 13 has dropped. The electric circuit through the consuming device 4 remains closed.

Figure 4:
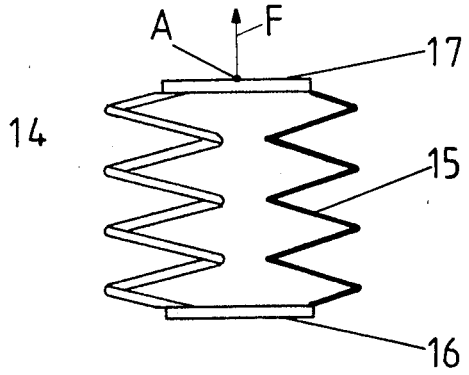
FIG. 4 is a schematic representation of a combined element consisting of a pressure spring made of a memory alloy and reacting spring in the basic non-actuated (low temperature) position.

FIG. 4 shows a schematic representation of a possible design of the element 8 of FIG. 1 in its basic position (low temperature). This combined element consists of a pressure spring 14 made of an alloy with shape memory which is capable of a two-way effect as well as of a reacting spring 15 designed as a tension spring. Each of the two springs is connected through a stationary plate 16 arranged at the bottom and an upper mobile plate 17. Naturally, the springs 14 and 15 can also be arranged towards each other in a different, for example, coaxial, way. The force "F" exerted by this combination which attacks at point "A " is indicated by means of an upwardly directed arrow.

Figure 5:
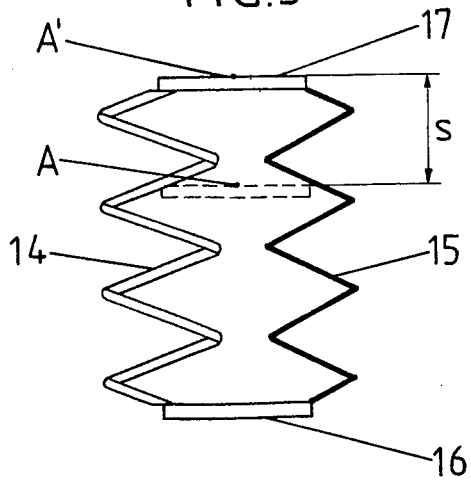
FIG. 5 is a schematic representation of a combined element according to FIG. 4 in its position after the setting-in of the memory effect (high temperature)

In FIG. 5, the combined element according to FIG. 4 is represented in the position which results after the memory effect has set in. Owing to the force exerted by the pressure spring 14 on the mobile plate 17, the point resting originally in "A" is now in "A'". The corresponding lift "s" is indicated in the drawing by tips of arrows.

Figure 6:
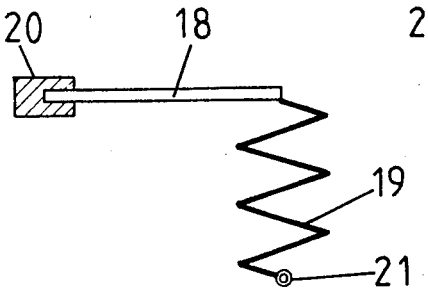
FIG. 6 is a schematic representation of a combined element consisting of a spiral spring made of memory alloy and reacting spring in the basic position (low temperature)

FIG. 6 shows a schematic representation of a combined element consisting of a bending 18 made of an alloy with shape memory and a reacting spring 19 designed as a tension spring in its basic position (low temperature). The bending 18 is totally clamped into the stationary piece 20 while the reacting spring 19 is suspended with its lower end in the stationary eye 21.

Figure 7:
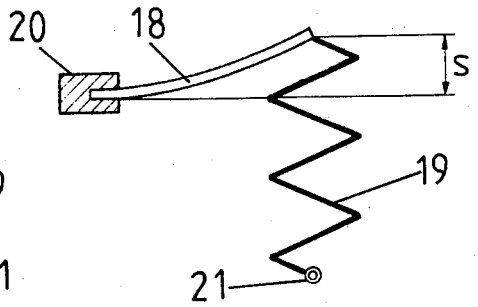
FIG. 7 is a schematic representation of a combined element according to FIG. 6 in the position after the setting-in of the memory effect (high temperature).

FIG. 7 shows a schematic representation of the combined element according to FIG. 6 in the position after the memory effect has set in (high temperature). The bending 18 is curved towards the top so that its free end in which the tension spring 19 engages is higher by the level of the lift "s" in comparison with the basic position.

Referring to FIGS. 1–3, a functional description of the invention is nextly provided.

In the basic position, the circuit breaker 2, 3 is open and no current flows. The element 8 consisting of a spring made of a memory alloy and of a normal reacting spring is at a temperature corresponding to the martensitic low temperature phase which is below the transformation temperature $M_s$. By means of a short-term actuation (a fraction of a second) of the push button 12, the stationary contacts 2 of the circuit breaker are bridged by means of the mobile contact portion 3 and the consuming device 4 is connected to the circuit. At the same time, current flows through the closed contacts 5 of the auxiliary switch and through the compensating resistor 7 which heats the element 8 either in a direct or indirect way within 100–500 msec. When the conversion temperature is exceeded, the memory alloy turns over into the austenitic high temperature phase whereby it suddenly undergoes a considerable change in length. In the present case, the element 8 expands in its longitudinal direction and pushes, through the traverse 9, the tripping pins 10 and 11 vertically towards the top. In this moment, the temperature of the element 8 has reached a value of, for example, 120°–200° C. The tripping pin 10 pushes the mobile contact portion 3 of the circuit breaker against the contacts 2 and thus assures continuing application of supply current to the consuming device 4 even after dropping of the push button 12. At the same time, the tripping pin 11 opens the auxiliary switch and interrupts the supply of current to the element 8. The continued heating is stopped and the cooling process sets in. After, for example, approximately 200 seconds, the conversion temperature (for example, approximately 60° C.) is reached and the spontaneous inverse memory effect sets in: the element 8 is suddenly contracted whereby the tripping pins 10 and 11 are pulled downwardly by means of the traverse 9. The mobile contact portion 3 of the circuit breaker drops off and interrupts the circuit. At the same time, the contacts 5 of the auxiliary switch are closed. Thus, the basic non-actuated low temperature position according to FIG. 1 is again assumed. The cooling process takes, for example, in the present case approximately 200 seconds but can be adjusted within certain limits by the physical data, such as transformation temperature, thermal capacity, spring characteristics, etc., of the element 8.

In this exemplified embodiment shown in FIGS. 4 and 5, the element 8 according to FIG. 1 consisted essentially of a pressure spring 14 made of an alloy with a memory and a reacting spring 15 (tension spring) connected in parellel. The pressure spring made of the alloy with a memory has the following characteristic data:

Composition:
- Ni: 49.5% by weight
- Ti: 45.5% by weight
- Cu: 5.0% by weight

Pressure spring:
- Mean coil diameter: 7 mm
- Number of coils: 5
- Wire diameter: 1.1 mm
- Electric resistance: 0.1Ω

Spring constant of the reacting spring: 0.5 N/mm

A resistance value of 3.3Ω was selected for the compensating resistor 7 (FIG. 1). The line voltage amounted to 200 VAC and the heating time for the pressure spring 14 was 100 msec. until the memory effect set in. The spontaneous change in length (lift "s") amounted to 10 mm whereby the point "A" was lifted to the point "A'" under the influence of a force of 5 N. The value of 5 N refers in this instance to the excess force which, after the deduction of the force of the reacting spring, was still available, on an average, for the actuation of the switch. The temperature of the pressure spring 14 amounted to approximately 120° C. at the moment of the maximum heating with the setting-in of the memory effect. The time to reach the conversion point of approximately 60° C. amounted to 200 seconds. This time is determined by the cooling period plus the time which is necessary in order to supply the energy which leads to the conversion into the martensitic structure of the pressure spring 14.

In the embodiment shown in FIGS. 6 and 7, the element 8 of FIG. 1 consists essentially of a bending 18 made of an alloy with a memory with a pasted-on insulated electric heating element and a reacting spring 19 (tension spring). The bending 18 consisting of an alloy with a memory has the following characteristic data:

Composition:
- Cu: 84% by weight
- Al: 13% by weight
- Ni: 3% by weight plate:
- Length: 50 mm
- Thickness: 2 mm
- Width: 6 mm Pasted-on electric heating element:
- Electric resistance: 60Ω

Compensating resistance =0 spring constant of the reacting spring: 1 N/mm

The line voltage amounted to 220 VAC and the heating time for the spiral spring 18 was 500 msec. until the memory effect set in. The spontaneous change in length (lift "s") amounted to 5 mm and the mean excess force to 5 N after the deduction of the force of the reacting spring. The temperature of the plate 18 amounted to 200° C. when the memory effect set in. The total time to reach the conversion point where the $\beta$ phase turns over into the martensitic condition was determined to come to 200 seconds. The corresponding temperature amounted to 120° C.

A structural simplification was made possible for time switches by the device according to the invention whereby complicated mechanisms, such as clock-works and such, are eliminated. An accurate and reliable operation of the unit is guaranteed and maintenance work is reduced owing to the considerable amplitude of the course of the motion and of the action of the force of the memory effect as well as of the hysteresis as a function of the temperature.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A time delay switch capable of connecting for a predetermined time period a consuming device to a power source via a first current path, comprising:

a first normally open circuit breaker including stationary and movable contacts adapted to be connected in series with said consuming device and said power source in said first current path;

an auxiliary normally closed circuit breaker having stationary and movable contacts connected in series with said first circuit breaker and said power source in a second current path;

a thermal element made of a memory alloy characterized by a two way temperature sensitive shape changing characteristic and having a predetermined thermal capacity;

a resistor electrically connected in series with said thermal element and thermally coupled thereto, said thermal element and said resistor connected in series with said first and second circuit breakers and said power source in said second current path, said thermal element having respective tripping pins mechanically coupled to the movable contacts of said first and second circuit breakers; and a push button activator coupled to the movable contact of said first circuit breaker and having a tripping pin capable of being manually translated to make a temporary electrical connection between the stationary and movable contacts of said first circuit breaker;

whereby when said push button activator makes said temporary electrical connection between the stationary and movable contacts of said first circuit breaker, a current is generated in said first and second current paths producing a heating of said thermal element and a corresponding shape change thereof such that the tripping elements of said thermal element move to maintain the electrical connection of the movable and stationary contacts of the said first circuit breaker and disconnect the stationary and movable contacts of said second circuit breaker such that the current in said second current path is interrupted, whereupon heating of said thermal element ceases and said thermal element returns to its shape prior to heating thereof after a predetermined time period whereupon the first circuit breaker returns to its normally open state and the second circuit breaker returns to its normally closed state.

* * * * *